US011313524B2

(12) United States Patent
Bianchi

(10) Patent No.: US 11,313,524 B2
(45) Date of Patent: Apr. 26, 2022

(54) LIGHTING DEVICE

(71) Applicant: Turn Lights S.r.l., Vicenza (IT)

(72) Inventor: Nereo Bianchi, Vicenza (IT)

( * ) Notice: Subject to any disclaimer, the term of this patent is extended or adjusted under 35 U.S.C. 154(b) by 0 days.

(21) Appl. No.: 17/050,901

(22) PCT Filed: Apr. 30, 2019

(86) PCT No.: PCT/IB2019/053535
§ 371 (c)(1),
(2) Date: Oct. 27, 2020

(87) PCT Pub. No.: WO2019/211748
PCT Pub. Date: Nov. 7, 2019

(65) Prior Publication Data

US 2021/0231272 A1 Jul. 29, 2021

(30) Foreign Application Priority Data

May 2, 2018 (IT) ..... 102018000005003

(51) Int. Cl.
*F21S 4/26* (2016.01)
*F21V 3/04* (2018.01)
(Continued)

(52) U.S. Cl.
CPC ..... *F21S 4/26* (2016.01); *F21V 3/049* (2013.01); *F21V 7/005* (2013.01); *F21Y 2103/10* (2016.08); *F21Y 2115/10* (2016.08)

(58) Field of Classification Search
CPC ..... F21S 4/28; F21S 4/26; F21S 4/22; F21Y 2103/10; F21Y 2115/10; G06F 1/266;
(Continued)

(56) References Cited

U.S. PATENT DOCUMENTS 10,584,836 B1 * 3/2020 Li ..... F21V 3/04
2010/0039813 A1 * 2/2010 Sloan ..... F21V 23/06 362/246

(Continued)

FOREIGN PATENT DOCUMENTS

DE 202010000997 U1 * 5/2011 ..... F21V 33/0028
DE 202014106077 12/2014

OTHER PUBLICATIONS

Wikipedia—Interference Fit; editorial board (Year: 2021).*

*Primary Examiner* — Rajarshi Chakraborty
*Assistant Examiner* — Glenn D Zimmerman
(74) *Attorney, Agent, or Firm* — Themis Law

(57) ABSTRACT

A lighting device, preferably a LED, includes a profiled element adapted to be applied to an external structure and coupled to a transparent or translucent longitudinal portion that allows the passage of a luminous flux generated by an illuminating element, preferably a LED strip, housed within a longitudinal chamber defined inside the profiled element. The profiled element also houses, in facing relationship to the illuminating element, a reflecting element oriented to reflect the luminous flux generated by the illuminating element toward the transparent or translucent longitudinal portion of the profiled element. The longitudinal chamber housing the illuminating element is separate from a second longitudinal chamber defined inside the profiled element and housing the reflecting element.

14 Claims, 2 Drawing Sheets

Figure 1:
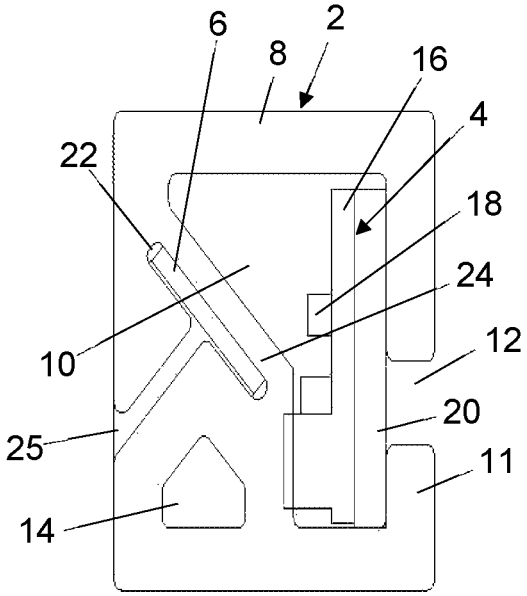

(51) Int. Cl.
*F21V 7/00* (2006.01)
*F21Y 103/10* (2016.01)
*F21Y 115/10* (2016.01)

(58) Field of Classification Search
CPC .. G06F 1/28; G06K 2209/03; G06K 9/00771; H01R 13/7175; H05K 7/1492; F21V 3/049; F21V 7/005; F21V 5/005; F21V 13/04
See application file for complete search history.

(56) References Cited

U.S. PATENT DOCUMENTS

2010/0110679 A1* 5/2010 Teng ..... F21V 7/0091 362/235
2011/0292652 A1 12/2011 Huang
2013/0155713 A1* 6/2013 Law ..... F21S 43/195 362/545
2014/0192521 A1* 7/2014 Laakkio ..... G02B 6/0045 362/145
2014/0332667 A1* 11/2014 Aramaki ..... F21V 7/04 250/208.1
2015/0217840 A1* 8/2015 Taylor ..... B63B 45/04 114/219
2016/0285234 A1* 9/2016 Okahisa ..... H01S 5/02255
2017/0248289 A1* 8/2017 Vasylyev ..... G02F 1/133603

* cited by examiner

LIGHTING DEVICE

The present invention relates to a lighting device, preferably a LED device.

LED lighting devices of the type comprising a metal or plastic section supporting a LEDs contained therein are known. They are used in a wide variety of applications and have proven useful both for their low consumption and for their versatility.

Generally the LEDs strip, which is rigid even though in certain applications may be more or less flexible, performs more functions and in particular supports both the LEDs and the tracks of the printed circuit, to which they are connected and through which they are powered, and at the same time it constitutes the mechanical interface between these and the section, through which the device is applied to any structural support element.

The very nature of the LEDs and their mode of operation means that the luminous flux generated by them is mainly directed orthogonally to the surface of the support strip, to which they are applied, and this constitutes a real limitation in the use of lighting LED devices, which generally illuminate the space in front of the surface of the support structure, to which the profile is applied.

Attempts have also been made to provide LED lighting devices capable of emitting a luminous flux in a direction parallel to or in any case slightly angled with respect to the application surface of the device itself, but in practice they have proved unsatisfactory given the nature of the LEDs themselves, and their suitability to generate a luminous flux directed mainly in a direction orthogonal to the surface of the strip, to which they are applied.

US2011/0058353, CN106764681 and EP2751477 describe a profiled element which is provided with a cavity, in which a LED strip is housed, and which is also provided with a reflecting material strip to reflect the luminous flux generated by the LED strip towards a transparent portion of the profile itself. In these known solutions, however, the section and the strip of reflecting material are obtained by coextrusion and this makes these solutions particularly complicated to manufacture, and therefore expensive.

The object of the invention is to propose a lighting device capable of eliminating and overcoming the aforementioned drawbacks present in traditional solutions.

Another object of the invention is to propose a lighting device, preferably a LED device, of the type comprising a LEDs strip housed within a containment section and constraint to a support structure, which is able to generate a light beam oriented mainly in a parallel direction or in any case slightly angled with respect to the surface of the support structure, to which the device itself is applied.

Another object of the invention is to propose a lighting device that can be produced in a simple, rapid and low-cost way.

Another object of the invention is to propose a lighting device with an alternative characterization, both in functional and implementation terms, with respect to the traditional ones.

Another object of the invention is to propose a lighting device with a configuration suitable for satisfying a large number of different installation and utilization requirements.

Another object of the invention is to propose a lighting device with high application flexibility.

Another object of the invention is to propose a lighting device which allows a high flexibility in the choice of the materials to be used for its realization.

Another object of the invention is to propose a lighting device that is highly customizable.

Another object of the invention is to propose a lighting device having a highly pleasing aesthetic appearance and suitable for providing the client or user with the feeling of being in front of a high-quality product, both aesthetically and functionally.

All of these objects and others which will become apparent from the description which follows are achieved according to the invention with a lighting device, preferably a led device, as defined in claim 1.

Figure 2:
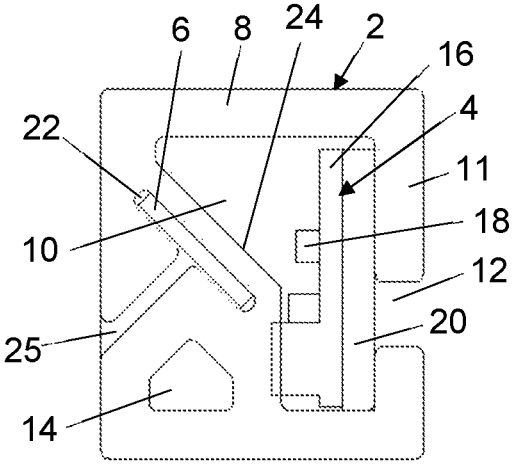
Figure 3:
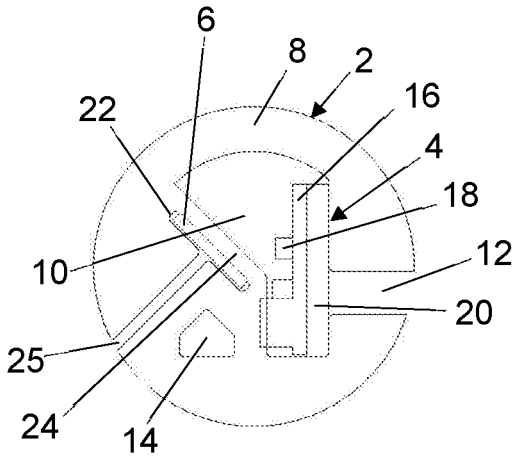
Figure 4:
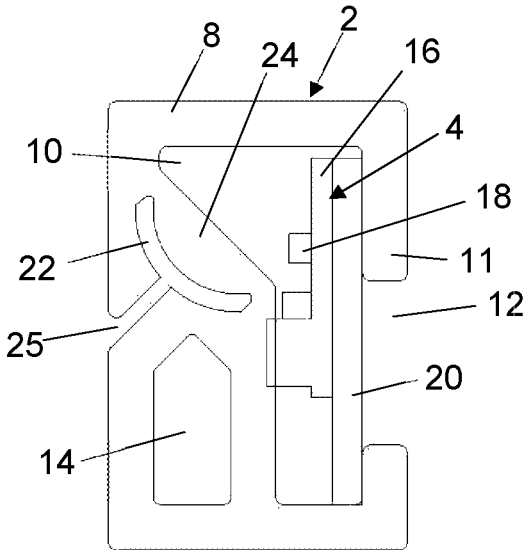
Figure 5:
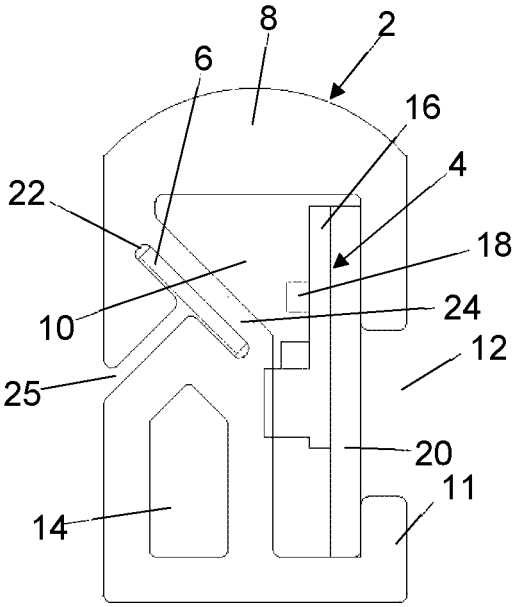
Figure 6:
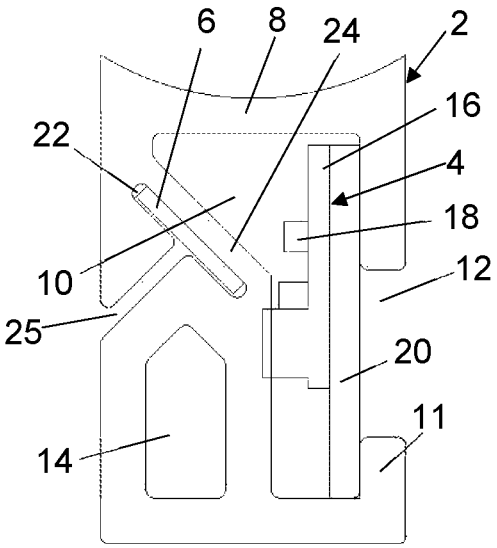
Figure 7:
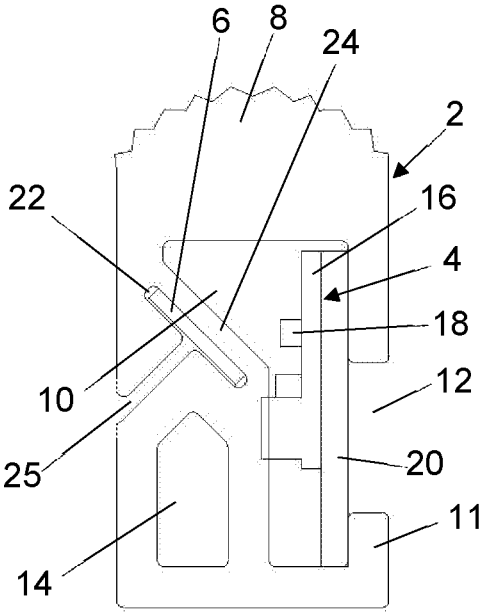
Figure 8:
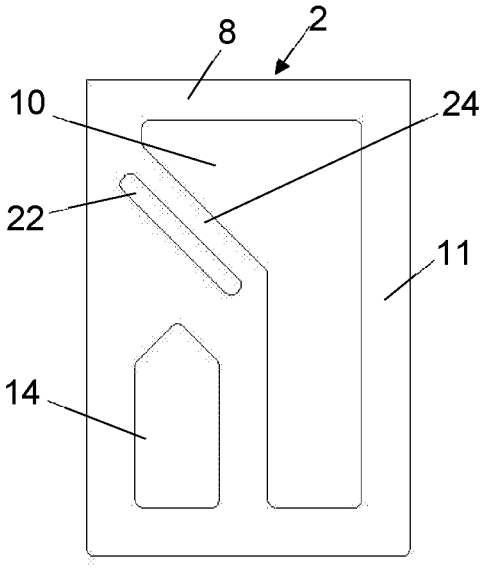

The present invention is further clarified hereinafter in some of its preferred embodiments which are given purely by way of a non-limiting example with reference to the accompanying drawings, in which:

FIG. 1 shows in schematic cross-section a lighting device according to the invention in a first embodiment, FIG. 2 shows it in the same view in a second embodiment, FIG. 3 shows it in the same view in a third embodiment, FIG. 4 shows it in the same view in a fourth embodiment, FIG. 5 shows it in the same view in a fifth embodiment, FIG. 6 shows it in the same view in a sixth embodiment, FIG. 7 shows it in the same view in a seventh embodiment, and FIG. 8 it shows in the same view in an eighth embodiment.

As can be seen from the figures, the lighting device, preferably of led type, comprises:

a support profiled element 2, an illuminating element 4, preferably defined by a LEDs strip, which is housed inside the profiled element 2, a reflecting element 6, which is also housed and/or formed inside the profiled element 2, and a portion 8 which is substantially transparent and/or translucent and which is associated and/or is formed/defined in said support profiled element 2; in particular, said portion 8 is such as to allow the passage of the luminous flux generated by said illuminating element 4 towards the outside.

Conveniently, inside the profiled element 2, said reflecting element 6 is in a position substantially facing the illuminating element 4 and is oriented so as to reflect towards said portion 8 of said profiled element 2, the luminous flux generated by said illuminating element 4. Preferably, the reflecting element 6 is substantially facing and inclined with respect to said illuminating element 4.

Advantageously, the profiled element 2 can be rigid or elastically deformable, at least in part. Conveniently, the profiled element 2 can be made of the most varied materials, both metal and plastic and composite, the latter having a part made of metal and a part made of plastic. Preferably, among the metallic materials the profiled element 2 can be advantageously made of aluminium, while among the plastic materials it can be made of polycarbonate, methacrylate and silicone and more preferably of platinic silicone.

Preferably, said substantially transparent and/or translucent portion 8 comprises a longitudinal band which is associated and/or is formed/defined in said profiled element 2 and which is suitable for being traversed by the luminous flux generated by the led strip 4.

Advantageously, the portion 8 can be made of the same material as the profiled element 2 or even in a different material. In particular, for example, if the profiled element 2 is made of plastic material, this must be wholly or partly made of transparent and/or translucent material; while if the profiled element 2 is made of metallic material, this longitudinal portion 8 thereof can be made of a plastic material coextruded with the metal material or it can be applied subsequently to the metal material with any traditional technique in itself.

Advantageously, the profiled element 2 presents at least one longitudinal chamber 10, intended to house the led strip 4. Preferably, this chamber 10 is delimited by at least one wall 11, which can be of a rectilinear/flat or curved extension, in correspondence with which the profiled element 2 is constrained (directly or by traditional fixing means) to an external support structure. In particular, preferably, the wall 11 can be associated with the means for constraining the profiled element 2 to an external structure. These constraining means can be of the mechanical or magnetic type or even of the adhesive type, and depending on their nature they can be made in the most varied types. Preferably, the illuminating element 4 is supported/associated at the inner surface of the wall 11 of the longitudinal chamber 10 (i.e. of the surface facing towards said chamber 10), while the means for the constraint of the profiled element 2 to an external structure are provided at the outer surface of the same wall 11.

Advantageously, as shown in the embodiments illustrated for example in FIGS. 1 to 7, said wall 11 of the longitudinal chamber 10 presents a longitudinal opening 12 for the insertion of the illuminating element 4. Preferably, especially if the profiled element 2 it is made of elastically deformable plastic material, the longitudinal opening 12 can be enlarged to allow the introduction of the led strip 4, as will be seen later.

Advantageously, the section of the profiled element 2 may have various shapes and, for example, may be rectangular (see FIG. 1) or square (see FIG. 2) or circular (see FIG. 3) or have any other shape (see FIGS. 5-7). Advantageously, the profiled element 2 also has other longitudinal cavities 14, which ensure a certain consistency of the thicknesses of the various areas of the profiled element 2, and this in order to ensure a substantial non-deformability of the extruded material during the cooling and shrinkage phase.

Conveniently, the led strip 4 can be conventional in itself: it comprises a support base 16 for the individual LEDs 18 and a pair of conductive longitudinal tracks, to which they are welded with traditional techniques.

Advantageously, the led strip 4 can be applied/fixed by any means, for example by gluing, to a support 20—preferably a support strip—which can be rigid or semi-rigid or flexible and which is intended to perform several functions; in particular, the support 20 can have the function of keeping the led strip 4 mechanically constrained to the profiled element 2, the function of supporting mechanical means for constraining the profiled element 2 to an external support structure and, if made of heat-conducting material, to contribute to the disposal of the heat that is generated when the LEDs 18 are on.

Suitably, if the longitudinal chamber 10 is of the closed tubular type, i.e. it has no longitudinal opening 12 defined in the wall 11 (see for example FIG. 8), the led strip 4—preferably with the relative support 20—can be introduced in it axially, whereas if the chamber itself is of the open tubular type (see for example FIGS. 1-7), i.e. it presents the longitudinal opening 12 and—preferably the section is made of elastically deformable material—the introduction of the led strip 4, preferably with the relative support 20, can take place through this longitudinal opening 12, after its edges have been slightly spaced apart.

Advantageously, the support means of the profiled element 2 can be associated with an external structure to the support strip 20. These constraining means can be of the mechanical or magnetic type or even of the adhesive type, and depending on their nature they can be made in the most varied types.

Advantageously, the longitudinal chamber 10 of the profiled element 2 which houses the illuminating element 4 can be filled with sealing material, for example with silicone or acrylic resins or the like, which ensures to the device a satisfactory water and moisture seal, and this is particularly useful if the lighting device is to be installed in open places or in damp environments. Suitably, this sealing material is substantially transparent to light.

Conveniently, the substantially transparent and/or translucent portion 8 of the profiled element 2 defines and/or is associated—at least in part—with a wall of the longitudinal chamber 10 which houses the illuminating element. Preferably, the substantially transparent and/or translucent portion 8 is adjacent to the wall of the profiled element 2, to which the led strip 4 is applied/associated.

Preferably, the substantially transparent and/or translucent portion 8 forms with the wall 11 on which the illuminated element 4 rests an angle of about 90°, although different values can be chosen depending on the use requirements of the lighting device.

Advantageously, this portion 8 which is substantially transparent and/or translucent, intended to be crossed by the light, can have a constant thickness, i.e. it can be delimited by two flat and parallel faces (see FIGS. 1, 2 and 4), but it can also have both curved surfaces (see FIG. 3) or have only one curved, so as to form a biconvex or biconcave or piano-convex wall (see FIG. 5) or piano-concave (see FIG. 6), and can be externally smooth or longitudinally ribbed (see FIG. 7) depending on the intended use requirements.

In the profiled element 2 it is also provided a further longitudinal chamber 22 for housing the element 6.

Preferably, the reflecting element 6 comprises a longitudinally developed strip/band which is housed within said further longitudinal chamber 22. Advantageously, the reflecting element 6 can be constituted by a metal or plastic foil presenting at least one smooth surface intended to reflect the light. This reflecting surface of the element 6, which can be flat (see for example FIGS. 1-3) or concave (as provided in FIG. 4), can be obtained with any traditional technique, which in itself does not constitute the subject of the invention. Advantageously, said strip of reflecting material is slightly curved around a longitudinal axis.

Advantageously, said further chamber 22 is configured (i.e. dimensioned and/or shaped) to internally retain and fix the reflecting element 6. Preferably, the reflecting element 6 can be locked inside said further chamber 22 by coupling by press-fit or by interlocking.

Preferably, said further longitudinal housing chamber 22 is arranged and oriented so as to be substantially facing and inclined with respect to said illuminating element 4. Said further longitudinal chamber 22 for housing the reflecting element 6 is distinct and separate from the longitudinal housing chamber 10 of the illuminating element 4. Advantageously, once the illuminating element 4 is housed within the chamber 10 and once the reflecting element 6 is housed within said further chamber 22, the aforementioned two chambers 10 and 22 are separated from one another and not communicating. Alternatively, the aforementioned two chambers 10 and 22 defined within the profiled element 2 are configured so as to always be mutually separate and not communicating, i.e. even before the insertion (and therefore in absence) of the reflecting element 6 and/or of the illuminating element 4.

Advantageously, the two chambers 22 and 10 are separated by a partition wall 24 which, preferably, is made of a substantially transparent and/or translucent material and is in any case suitable for allowing the passage of the light flow generated by said illuminating element 4 towards the reflecting surface of said reflecting element 6, as well as to allow the passage towards the substantially transparent and/or translucent portion 8 of the luminous flux reflected by said reflecting element 6.

Advantageously, the partition wall 24, for separating the two chambers 22 and 10, can be made of the same material that forms the profiled element 2, or of a different material and applied subsequently.

Advantageously, in an embodiment not shown, the partition wall 24 is integrated in said reflecting element 6 and, therefore, the two chambers 10 and 22 are separated from each other only after the insertion of said reflecting element 6 within the corresponding further chamber 22. Alternatively, the partition wall 24 can be defined by a different piece separated from the profiled element 2, as well as from the illuminating element 4 and the reflecting element 6.

Conveniently, the further chamber 22 can also be of the closed tubular type, and in this case the reflecting element 6 can be introduced into it axially, or it can be provided with its own corresponding insertion opening 25 (and thus be of the open tubular type), and in this case the reflecting element 6 can be introduced inside said further chamber 22 through its opening 25, preferably after having its edges spread apart.

Appropriately, in essence, the longitudinal chamber 10, which houses said illuminating element 4, is constituted by a tubular cavity obtained in said profiled element 2, which preferably presents a corresponding longitudinal opening 12 for the insertion of said illuminating element 4 within said chamber, while said further longitudinal chamber 22, which houses said reflecting element 6, is constituted by a tubular cavity obtained in said profiled element 2, which preferably presents a corresponding longitudinal opening 25 for the insertion of said reflecting element 6 within said further chamber.

Conveniently, independently of the embodiment adopted, the relative position of the reflecting element 6 (housed in said further chamber 22) with respect to the illuminating element 4 (housed in the chamber 10) must be such as to cause the incident light beam generated by said illuminating element 4 to go towards the substantially transparent and/or translucent portion 8 of and/or associated with the profiled element 2.

Preferably, if the substantially transparent and/or translucent portion 8 is arranged at about 90° with respect to the wall 11 of the profiled element 2, to which the illuminating element 4 is applied, the reflecting element 6 forms an angle of about 45° with both these walls.

Advantageously, the width of the reflecting element 6 is suitably correlated with the dimensions of the profiled element 2 and with the relevant position of the various parts, so that the reflecting element 6 is always able to collect the entire light beam emitted by the illuminating element 4 and reflecting it to make it cross the portion 8 of the profiled element 2 and/or associated with the latter.

From the aforegoing it is apparent that the lighting device according to the invention is particularly advantageous with respect to traditional solutions. In particular, from the point of view of its installation, the device according to the present invention is practically similar to traditional devices, but instead of emitting a light beam orthogonally to the surface or wall 11 of the profiled element 2 intended to be applied to the support surface, it emits the beam parallel or almost/substantially parallel to that surface. Conveniently, this allows to widen the field of use of LED lighting devices and to satisfy needs that in the past could not be satisfied.

In particular—unlike US2011/0058353, CN10664681 and EP2751477—in the device according to the present invention, the longitudinal chamber 10, which houses the illuminating element 4, is separated from said further longitudinal cavity 22, which houses the reflecting element 6. Advantageously, in this way it is not necessary for the reflecting element to be made by coextrusion with the section bar, thus allowing to simplify the construction of the device, as well as to have greater flexibility both in the dimensions and in the choice of the material of the reflecting element.

The invention claimed is:

1. A lighting device comprising:

a profiled element adapted to be applied to an external structure and made from an elastically deformable material;

a transparent or translucent longitudinal portion coupled to said profiled element and configured to allow passage of a luminous flux generated by a LED strip operating as an illuminating element, housed within a longitudinal chamber defined inside said profiled element, said wall having a longitudinal opening; and a reflecting element housed in said profiled element in facing relationship to said illuminating element and oriented to reflect the luminous flux generated by said illuminating element towards said transparent or translucent portion coupled to said profiled element, wherein said longitudinal chamber, which houses the illuminating element, is separate from a second longitudinal chamber which is defined inside said profiled element and which houses said reflecting element, and wherein said LED strip is applied onto a support having thermo-dissipating properties, said support being engaged to an inner side of said wall so as to close said longitudinal opening and being directly coupled to means for constraining said profiled element to said external structure.

2. The lighting device according to claim 1, wherein:

said transparent or translucent portion comprises a longitudinal band, which is formed in said profiled element or is associated to said profiled element, and is adjacent to said wall, and said reflecting element comprises a strip of reflecting material which is facing and inclined with respect to said LED strip.

3. The lighting device according to claim 1, wherein said transparent or translucent portion consists of:

a flat wall, bounded by two parallel faces, a curved wall delimited by two parallel faces, a biconvex or biconcave wall, or a flat-convex wall or a flat-concave wall.

4. The lighting device according to claim 1, wherein said longitudinal chamber of said profiled element which houses the illuminating element is filled with a sealing material resistant to water and humidity.

5. The lighting device according to claim 1, wherein:

said longitudinal chamber, which houses said illuminating element, is shaped as a tubular cavity obtained in said profiled element and has a corresponding longitudinal opening for insertion of said illuminating element within said longitudinal chamber, and said second longitudinal chamber, which houses said reflecting element, is shaped as a separate tubular cavity obtained in said profiled element and has a second corresponding longitudinal opening for insertion of said reflecting element within said second longitudinal chamber.

6. The lighting device according to claim 1, wherein said reflecting element comprises a strip of reflecting material that is curved around a longitudinal axis.

7. The lighting device according to claim 1, wherein said longitudinal chamber housing the illuminating element comprises a wall, in which:

at an inner surface of said wall, said illuminating element is applied, and at an outer surface of said wall, there are associated means for constraining the profiled element to the external structure.

8. The lighting device according to claim 1, wherein said transparent or translucent portion is made of:

a same material as said profiled element, or a different material with respect to said profiled element and is subsequently applied to said profiled element.

9. The lighting device according to claim 1, wherein said longitudinal chamber, which houses the illuminating element, is separated from the second longitudinal chamber, which houses the reflecting element, by a partition wall.

10. The lighting device according to claim 1, wherein said profiled element is made of a silicone material.

11. The lighting device according to claim 1, wherein said second longitudinal chamber is configured to hold and lock the reflecting element therein.

12. The lighting device according to claim 2, wherein the wall of said longitudinal chamber, to which said illuminating element is applied, and the transparent or translucent portion are arranged perpendicularly to each other and said reflecting element is arranged at 45° with respect to the wall and the transparent or translucent longitudinal portion.

13. The lighting device according to claim 9, wherein said partition wall is made of a transparent or translucent material adapted to allow the passage towards said reflecting element of the luminous flux generated by said illuminating element.

14. The lighting device according to claim 9, wherein said partition wall is made of:

a same material as said profiled element, or a different material with respect to said profiled element and is applied after said profiled element is manufactured.

* * * * *